United States Patent [19]

Miyakawa et al.

[11] Patent Number: 4,608,745

[45] Date of Patent: Sep. 2, 1986

[54] METHOD OF ATTACHING FLY STRIPS TO A SLIDE FASTENER CHAIN

[75] Inventors: Kazuo Miyakawa, Marietta, Ga.; Tatsuo Osaki, Uozu; Toshiaki Sawada, Toyama, both of Japan; Kiichiro Ishikawa, Marietta, Ga.

[73] Assignee: Yoshida Kogyo K. K., Tokyo, Japan

[21] Appl. No.: 659,528

[22] Filed: Oct. 10, 1984

[30] Foreign Application Priority Data

Oct. 17, 1983 [JP] Japan ..... 58-193600

[51] Int. Cl.[4] ..... B21D 53/50; D05B 3/12

[52] U.S. Cl. ..... 29/408; 112/265.2

[58] Field of Search ..... 29/408–410, 29/766–770, 33.2; 112/265.2, 121.27

[56] References Cited

U.S. PATENT DOCUMENTS 3,685,471 8/1972 Reynolds ..... 112/121.29
3,685,474 8/1972 Frohlich et al. ..... 112/265
4,137,859 2/1979 Itoh ..... 112/265
4,362,116 12/1982 Sen Gupta ..... 112/265.2
4,411,211 10/1983 Heimberger ..... 112/265.2

*Primary Examiner*—Mark Rosenbaum
*Assistant Examiner*—Steven Nichols
*Attorney, Agent, or Firm*—Hill, Van Santen, Steadman & Simpson

[57] ABSTRACT

In a method for automatically attaching successive fly strips to a continuous slide fastener chain, the successive strips are fed to a standby point one after another by a conveyor horizontally spaced from a sewing machine by a gap in which the standby point is disposed. A preceding strip is supplied from the standby point to the sewing machine with its trailing end portion hanging in the gap, while a succeeding strip is kept waiting at the standby point for a subsequent supply. When the trailing end of the preceding strip has passed a fixed point downstream of the standby point in the gap as the sewing of the preceding strip progresses, the succeeding strip is supplied at a speed higher than the rate at which the sewing of the preceding strip progresses.

3 Claims, 10 Drawing Figures

METHOD OF ATTACHING FLY STRIPS TO A SLIDE FASTENER CHAIN

BACKGROUND OF THE INVENTION

1. Field of the Invention:

The present invention relates to the production of trouser closures for fly openings, and more particularly to a method of attaching successive fly strips continuously onto a continuous slide fastener chain.

2. Prior Art:

In the manufacture of trouser closures for fly openings, it is known to feed successive fly strips to a sewing machine one after another by means of a conveyor with each fly strip stretched along its entire length. A common problem with the known method is that it is necessary to manually correct the difference in gaps between the successive fly strips supplied each and every time the supply of a succeeding fly strip is delayed due to a delay in any previous processing stage of the fly strip. This known method is subject to human error and worker fatigue, typically causing inefficient and non-uniform attachment of the fly strips. Further, since each fly strip is supplied from the conveyor to the sewing machine in fully stretched form, it is necessary to provide a relatively wide gap between the sewing machine and the conveyor, thus making a whole attaching system or apparatus inconveniently long.

SUMMARY OF THE INVENTION

In the present method, successive fly strips are fed to a standby point one after another by a conveyor horizontally spaced from a sewing station by a gap in which the standby point is disposed. A preceding fly strip is supplied from the standby point to the sewing station with its trailing end portion hanging in the gap, while a succeeding fly strip is kept waiting at the standby point for a subsequent supply when the trailing end of the preceedng fly strip passes a fixed point downstream of the standby point in the gap as the sewing of the preceding fly strip progresses, the succeeding fly strip is supplied to the sewing station at a speed higher than the rate at which the sewing of the preceding fly strip progresses.

It is accordingly an object of the present invention to provide a method of automatically attaching successive fly strips to a continuous slide fastener chain with adequate accuracy, causing an improved rate of production.

Another object of the present invention is to provide an automatic fly-strip attaching method which can be carried out by a relatively short system or apparatus.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
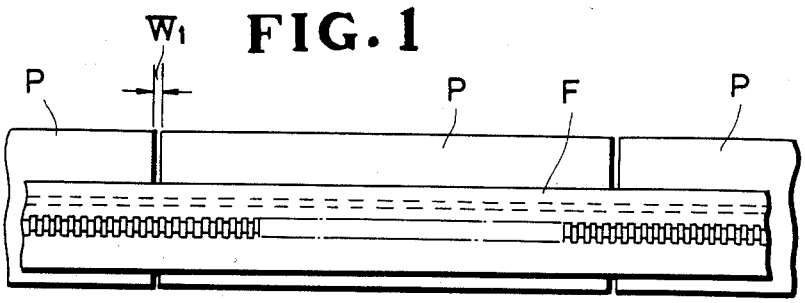
FIG. 1 is a fragmentary plan view of a succession of fly strips having been attached to a continuous slide fastener chain according to the present method.

FIG. 1 shows a succession of fly strips P of fabric having been attached to a continuous slide fastener chain F, with a predetermined gap $W_1$ between each adjacent pair of the fly strips P, P in accordance with the present method described below.

Figure 2:
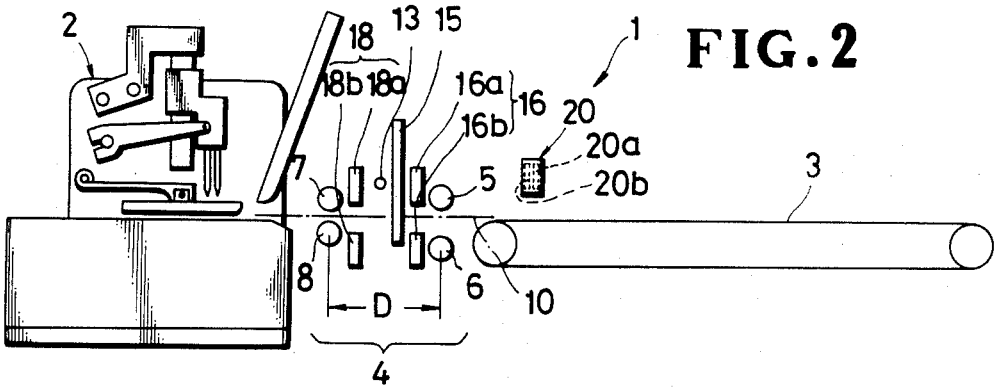
FIG. 2 is a front elevational view of an apparatus for use in carrying out the method.
Figure 3:
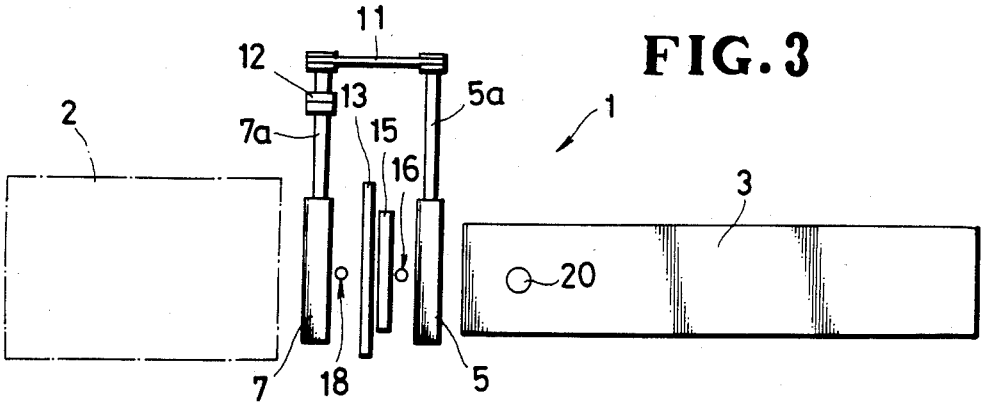
FIG. 3 is a plan view of the system of FIG. 2, with a sewing machine schematically illustrated in dash-and-dot lines.

FIGS. 2 and 3 show an automatic apparatus 1 for use in carrying out the present method. The appraratus 1 generally comprises a sewing machine 2 defining a sewing station, and a conveyor 3 for feeding the successive fly strips P to a supply station one after another, the conveyor 3 being horizontally spaced from the sewing machine 2 by a gap 4 in which the supply station is disposed. In the supply station, the successive fly strips P are automatically supplied to the sewing machine 2 one after another in timed relation to the continuous delivery of the fastener chain F to the sewing machine 2. The sewing machine 2 may be a conventional type on the market; the details of the sewing machine 2 itself are not pertinent here and its detailed description is omitted for brevity.

The supply station includes a pair of first rollers 5, 6 disposed in the gap 4 adjacent to the conveyor 3, and a pair of second rollers 7, 8 disposed in the gap 4 adjacent to the sewing machine 3 and spaced from the first rollers 5, 6 by a predetermined distance D along a horizontal path 10 (FIG. 2). Each pair of the first and second rollers 5, 6; 7, 8 are vertically opposed with respect to the horizontal path 10. A shaft 5*a* (FIG. 3) of the upper first roller 5 is driven by a motor (not shown) for clockwise rotation, and a shaft 7*a* (FIG. 3) of the upper second roller 7 is corotatably connected with the upper first roller's shaft 5*a* by means of an endless timing belt 11 and a clutch 12 (FIG. 3). The lower first and second rollers 6, 8 serve to press the fly strip P against the upper first and second rollers 5, 7, respectively, to thereby feed the fly strip P toward the sewing machine 2. The feed speed of the fly strip P by the rollers 5, 6; 7, 8 is higher than the rate at which the sewing of the fly strip P by the sewing machine 2 progresses, for a purpose described below.

The supply station also includes a push bar 13 disposed intermediately between the pair of first rollers 5, 6 and the pair of second rollers 7, 8. The push bar 13 extends transversely of the path 10 and is movable vertically, i.e. perpendicularly to the general plane of the fly strip P, beyond the path 10 between an upper position (FIGS. 2, 4, 5, 7–10) in which the push bar 13 is disposed above the path 10 and a lower position (FIG. 6) in which the push bar 13 is disposed beneath the path 10, thereby pushing a trailing end portion 14 of the fly strip P downwardly to cause the same to be hung in the gap 4.

A fly-strip stop 15 is disposed at a standby point immediately upstream of the push bar 13 and extends transversely of the path 10. The fly-strip stop 15 is movable vertically, i.e. perpendicularly to the path 10 between an upper position (FIGS. 4, 5, 8–10) in which the stop 15 is disposed above the path 10 to allow the fly strip P to move toward the sewing machine 2 and a lower position (FIGS. 2, 6, 7) in which the stop 15 is disposed across the path 10 to keep a succeeding fly strip P2 waiting for a subsequent supply to the sewing machine 2.

Figure 7:
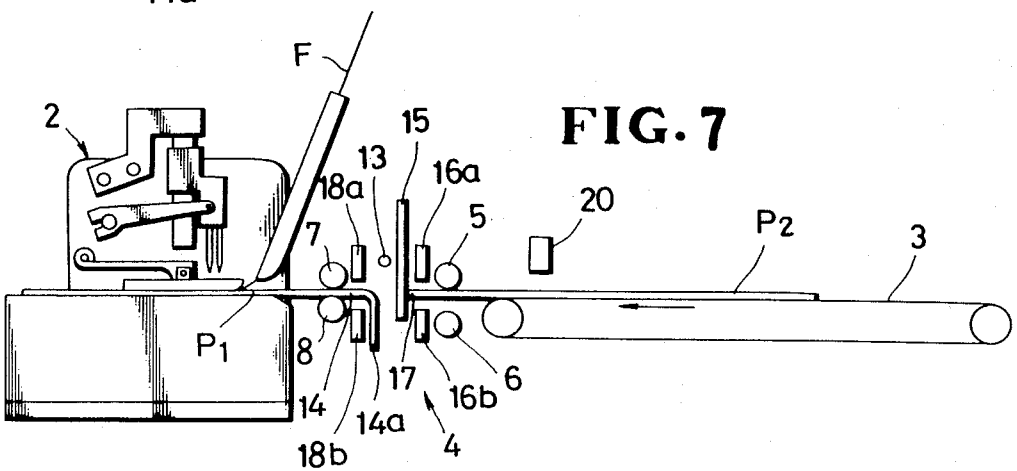

Disposed between the fly-strip stop 15 and the pair of first rollers 5, 6 is a first detector 16 for detecting when a leading end 17 of the fly strip P arrives at the standby point (FIG. 7). The first detector 16 includes a first light source 16*a* disposed above the path 10, and a first photoelectric cell 16*b* disposed beneath the path 10 for receiving light from the first light source 16*a*. The first photoelectric cell 16*b* is operative, upon arrival of the fly strip P, to produce a pulse signal for de-energizing the conveyor 3 and also for bringing up the fly-strip stop 15 away from the path 10, as shown in FIG. 8.

Figure 8:
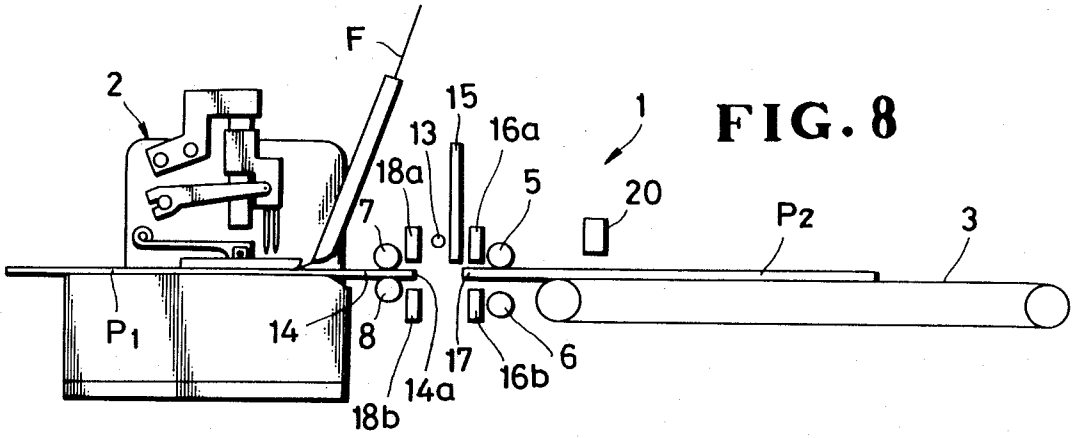

A second detector 18 is disposed between the push bar 13 and the pair of second rollers 7, 8 for detecting when a trailing end 14*a* of the fly strip P being sewn arrives at the second detector 18 (FIG. 8). The second detector 18, like the first detector 16, includes a second light source 18*a* disposed above the path 10, and a second photoelectric cell 18*b* disposed beneath the path 10 for receiving light from the second light source 18*a*. The second photoelectric cell 18*b* is operative, upon arrival of the trailing end 14*a* of the preceding fly strip $P_1$, to produce a pulse signal for bringing up the lower first roller 6 to cooperate with the upper first roller 5 to feed the succeeding fly strip $P_2$ toward the sewing machine 2 (FIG. 9) and also for energizing the clutch 12 (FIG. 3) to operatively connect the second rollers 7, 8 with the first rollers 5, 6 for corotation.

Figure 6:
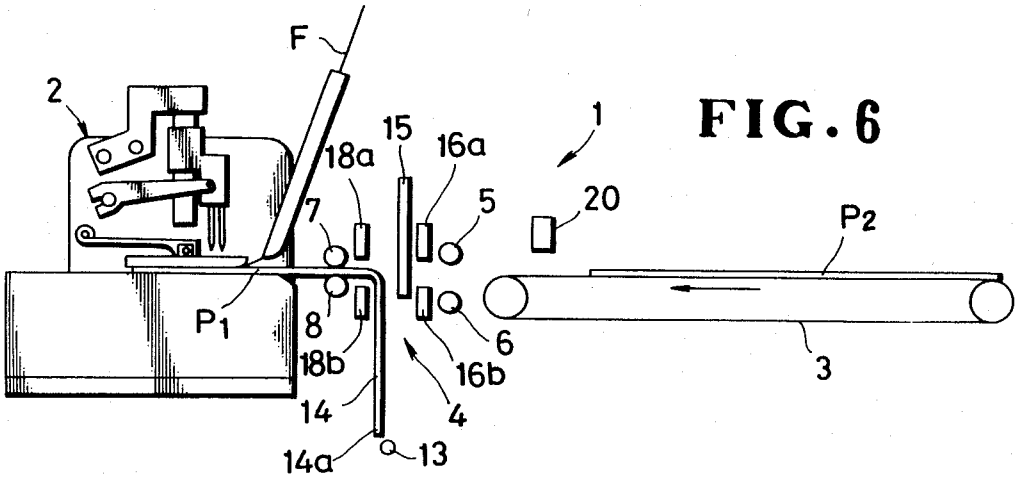

A third detector 20 is disposed above the conveyor 3 for detecting when the trailing end 14*a* of the fly strip P being sewn arrives at a predetermined point on the conveyor 3 near the downstream end thereof. The third detector 20 has a light source 20*a* (FIG. 2) built in a housing for emitting light at an angle onto the surface of the conveyor 3, and a photoelectric cell 20*b* (FIG. 2) built in the same housing for receiving light emitted from the light source 20*a* and then reflected on the surface of the conveyor 3. When the trailing end 14*a* of the fly strip P has passed the predetermined point (at 20) as the sewing of the fly strip P by the sewing machine 2 progresses, the photoelectric cell 20*b* is operative to produce a signal for lowering each of the push bar 13, the fly-strip stop 15 and the lower first roller 6, from the position of FIG. 5 to the position of FIG. 6. At the same time, the clutch 12 (FIG. 3) is de-energized to operatively disconnect the second rollers 7, 8, from the first rollers 5, 6, and the conveyor 3 is energized again to feed the next fly strip $P_2$ toward the standby point (at the stop 15), as shown in FIG. 6.

The fly-strip stop 15, the push bar 13 and the lower first roller 6 are associated with non-illustrated drive mechanisms of a known type; the details of each mechanism itself are not pertinent here and its description is also omitted.

Figure 4:
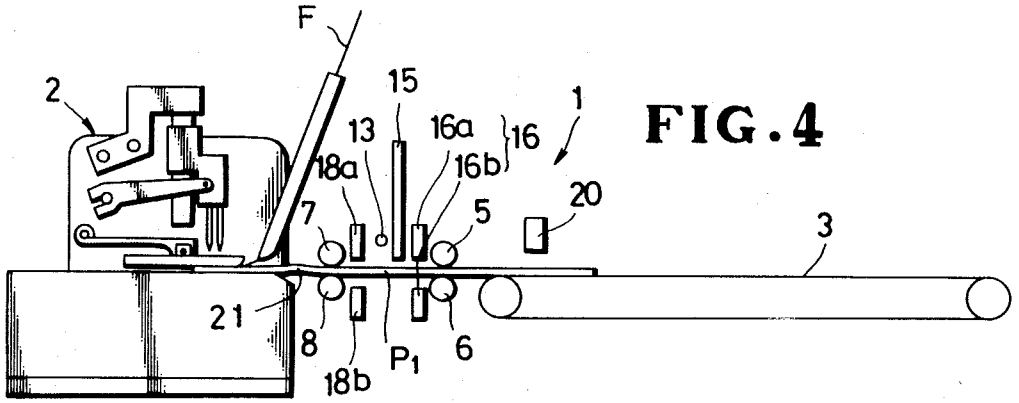
FIGS. 4 through 10 are front elevational views of the system of FIG.2, illustrating various stages of the sewing of the successive fly strips.
Figure 5:
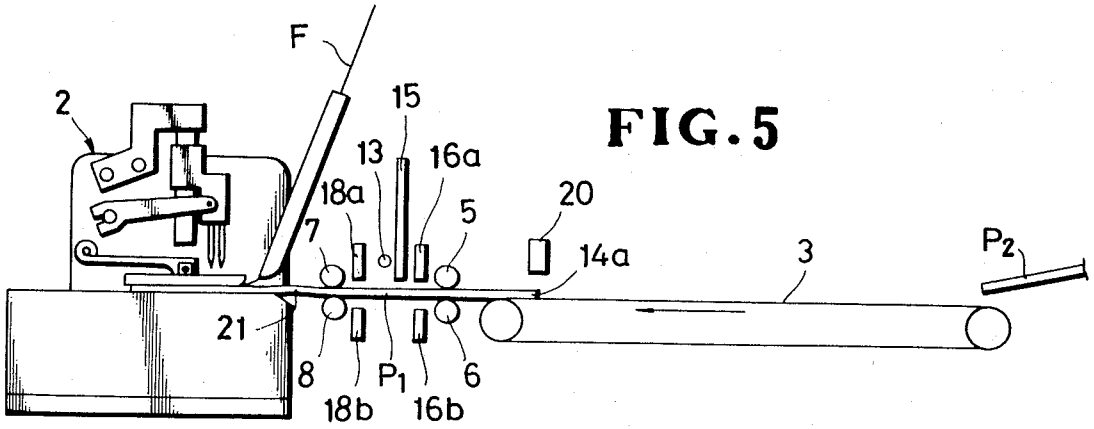

The method in which the successive fly strips P are attached to the continuous slide fastener chain F on the apparatus 1 mentioned above is as follows:

FIG. 4 illustrates the preceding fly strip $P_1$ having been supplied to the sewing machine 2 and being thereby sewn onto the fastener chain F, with the push bar 13 and the fly-strip stop 15 retracted to their upper position. At that time, the lower first roller 6 is in raised position to feed the fly strip $P_1$ in cooperation with the upper first roller 5, and the conveyor 3 is inoperative. Since the feed speed of the fly strip $P_1$ by the rollers 5, 6, 7, 8 is slightly higher than the rate at which the sewing of the fly strip $P_1$ by the sewing machine 2 progresses, there is a slack 21 developed in the fly strip $P_1$ between the sewing machine 2 and the second rollers 7, 8.

When the trailing end 14*a* of the preceding fly strip $P_1$ has passed under the third detector 20 (FIG. 5) as the sewing of the fly strip $P_1$ by the sewing machine 2 progresses, the photoelectric cell 20*b* of the third detector 20 becomes operative to produce a pulse signal, whereupon the push bar 13, the fly-strip stop 15 and the lower first roller 6 are lowered to the position of FIG. 6. This pulse signal also causes the conveyor 3 to be operative. This lowering of the push bar 13 causes the trailing end portion 14 of the fly strip $P_1$ to be hung in the gap 4 between the fly-strip stop 15 and the second detector 18. The push bar 13 then returns to the original or upper position. Meanwhile the conveyor 3 is continued to be operative to feed the succeeding fly strip $P_2$ leftwardly, i.e. toward the sewing machine 2. In its lower position the fly-strip stop 15 is disposed across the path 10 at the standby point to halt the succeeding fly strip $P_2$, as shown in FIG. 7.

When the leading end 17 of the succeeding fly strip $P_2$ passes across the light path between the light source 16*a* and the photoelectric cell 16*b*, the latter produces a pulse signal to de-energize the conveyor 3. Subsequently, when the leading end 17 of the succeeding fly strip $P_2$ reaches the fly-strip stop 15, the latter is returned to its original or raised position, as shown in FIG. 8.

Figure 9:
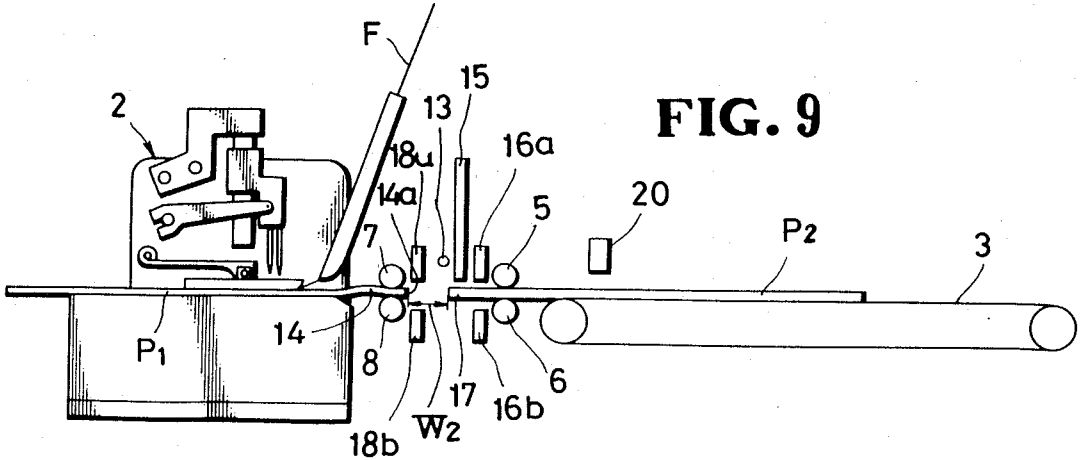

When the trailing end 14*a* of the preceding fly strip $P_1$ has passed across the light path between the second light source 18*a* and the second photoelectric cell 18*b* as the sewing progresses, the second photoelectric cell 18*b* produces a pulse signal to raise the lower first roller 6 to feed the succeeding fly strip $P_2$ toward the sewing machine 2 in cooperation of the upper first roller 5, as shown in FIG. 9. At the same time the clutch 12 (FIG. 3) is energized to operatively connect the second rollers 7, 8 with the first rollers 5, 6 for corotation. At that time the leading end 17 of the succeeding fly strip $P_2$ is spaced apart from the preceding fly strip's trailing end 14*a* by a distance $W_2$.

Figure 10:
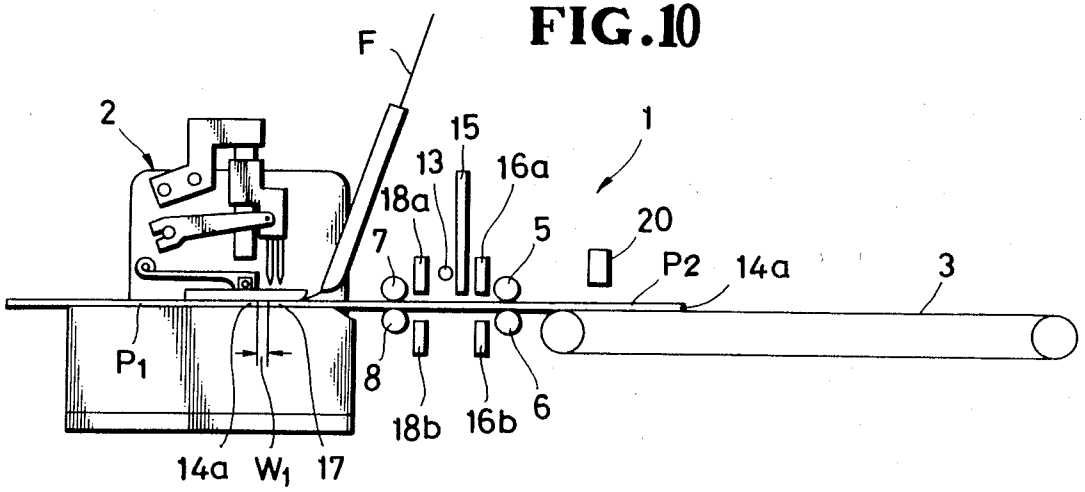

This distance $W_2$ is reduced to the gap $W_1$ (FIG. 1) by the time the succeeding fly strip's leading end 17 arrives at the sewing station, as shown in FIG. 10, because the feed speed of the succeeding fly strip $P_2$ by the rollers 5, 6, 7, 8 is higher than the rate at which the sewing of the preceding fly strip $P_1$ progresses. Thus the successive fly strips P are sewn onto the fastener chain F virtually continuously with the predetermined gap $W_1$ between each adjacent pair of fly strips P, as shown in FIG. 1. This gap $W_1$ is determined by the position of the fly-strip stop 15, the difference between the feed speed of the rollers 5, 6 and the sewing speed of the sewing machine 2, and the starting time point of feeding the fly strip P by the rollers 5, 6.

With the present method, it is possible to determine the sewing speed of the sewing machine 2 and the feeding speed of the conveyor 3 independently of each other without the need of synchronizing one with the other, thus giving a wide design allowance to the apparatus by which the present method is to be carried out.

Another advantage of the method is that a delay in any previous processing stage of the fly strip P can be absorbed or corrected by the time the fly strip P arrives at the sewing station, causing an accurate attachment of the fly strips P with uniform gaps $W_1$ between adjacent fly strips.

Further, since the trailing end portion 14 of the individual fly strip P is hung in the gap 4 between the sewing machine 2 and the conveyor 3 while the fly strip P is being progressively sewn onto the fastener chain F, it is possible to reduce the entire length of the apparatus by which the present method is to be carried out.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of attaching successive fly strips continuously to a continuous slide fastener chain, comprising:

(a) continuously delivering the continuous slide fastener chain to a sewing station;

(b) feeding the successive fly strips one after another to a standby point by a conveyor horizontally spaced from said sewing station by a gap in which said standby point is disposed;

(c) supplying a preceding fly strip from said standby point to said sewing station for sewing said preceding strip onto the fastener chain;

(d) detecting when a trailing end of said preceding fly strip passes a first fixed point upstream of said standby point near a downstream end of the conveyor;

(e) in response to said detection, positively displacing the trailing end portion of said preceding fly strip downwardly to cause the same to be hung in said space while keeping a succeeding fly strip waiting at said standby point for being subsequently supplied to said sewing station;

(f) further detecting when the trailing end of said preceding fly strip passes a second fixed point downstream of said standby point in said gap as the sewing of said preceding fly strip progresses; and (g) in response to said further detection, supplying said succeeding fly strip to said sewing station for sewing said succeeding fly strip onto the fastener chain.

2. A method according to claim 1, said feeding of the individual fly strips being done at a speed higher than the rate at which the sewing of said preceding strip progresses.

3. A method according to claim 2, said succeeding fly strip being sewn onto the fastener chain spaced away from the trailing end portion of said preceding fly strip by a gap.

* * * * *